US005755040A

United States Patent [19]

Ou

[11] Patent Number: 5,755,040

[45] Date of Patent: May 26, 1998

[54] HOUSEHOLD DRYING CENTER

[76] Inventor: Chan-Chou Ou, 12F.No.275, Yuan-Hua Rd., Chungli,Taoyuan Hsien, Taiwan

[21] Appl. No.: 853,788

[22] Filed: May 9, 1997

[51] Int. Cl.[6] ..... F26B 19/00

[52] U.S. Cl. ..... 34/202; 34/225

[58] Field of Search ..... 34/89, 90, 138, 34/170, 192, 194, 197, 202, 204, 218, 224, 225, 237, 239, 240; 211/88, 181, 204; 312/229, 249.9, 213

[56] References Cited

U.S. PATENT DOCUMENTS

| | | | |
|---|---|---|---|
| 5,546,678 | 8/1996 | Dhaemers | 34/275 |
| 5,555,640 | 9/1996 | Ou | 34/202 |
| 5,666,743 | 9/1997 | Dawson | 34/219 |

*Primary Examiner*—Henry A. Bennett
*Assistant Examiner*—Steve Gravini
*Attorney, Agent, or Firm*—W. Wayne Liauh

[57] ABSTRACT

A multipurpose dryer which can serve as a household drying center to provide versatile drying function for a wide variety of clothing, fabric articles and other household goods. A cabinet has a heating chamber located at the bottom of the cabinet for generating forced and heated air as drying medium. There is a heated air chamber to receive and distribute heated air to a drying chamber located below the top wall of the cabinet and above the heated air chamber. There are hollow air ducts attached to the side walls of the cabinet and a perforate heat diffusion plate above the heated air chamber for evenly distributing heated air into the drying chamber. A versatile support means is disposed in the drying chamber for hanging clothes, draping large size or bulky goods, or supporting a wire basket for holding delicate drying goods. The clothes and goods are dried without tumbling, thus avoiding fraying or wrinkles.

13 Claims, 7 Drawing Sheets

HOUSEHOLD DRYING CENTER

BACKGROUND OF THE INVENTION

1. Field of the Invention

This invention relates to an improvement for a multipurpose dryer which can serve as a household drying center and for which a patent was granted to the applicant under U.S. Pat. No. 5,555,640.

2. Description of the Prior Art

In the U.S. Pat. No. 5,555,640, the applicant disclosed a household drying center which includes a heating chamber located at an upper portion of a cabinet. A blower is disposed above the top wall of the cabinet to generate forced air into the heating chamber. Forced air is heated by a heating element located in the heating chamber. Heated air then flows into a drying chamber located in the middle and lower portions of the cabinet via a perforate heat diffusion plate at the bottom of the heating chamber and a plural number of vertical air ducts disposed on the side walls of the cabinet. Flowing heated air performs drying function for the goods held in the drying chamber. Moisture-laden air is then discharged out of the drying chamber through an air discharge means located at the bottom of the cabinet. A multifunctional support means is provided in the drying chamber for holding drying goods.

According to heat convection theory, heated air and vapor are normally flowing upward in atmosphere because they have lighter density than room temperature air. In the disclosed embodiment of U.S. Pat. No. 5,555,640, heated air is being generated in the heating chamber located at the upper portion of the cabinet and being forced downward by the blower. Moisture-laden air is also being discharged in downward direction to the bottom of the cabinet before exit to atmosphere. The air flowpath set forth above is against the natural air convection flow and could result in a drop of heat exchange and drying efficiency.

SUMMARY OF THE INVENTION

In view of aforesaid disadvantage, it is therefore an object of this invention to provide an improvement for a multipurpose dryer that can achieve more effective heated air convection flow in the drying chamber and thus enhances the drying efficiency.

According to this invention, a heating chamber which generates forced and heated air is located at the lower portion of the cabinet and is below a drying chamber. A perforate heat diffusion plate is slantly disposed above the heating chamber to allow heated air flowing into the drying chamber. The slant heat diffusion plate also serves as a drain board for collecting and flushing the drips from the wet laundry or the drying goods. The heat diffusion plate has slots in the side edges. Each slot engages with a hollow air duct which is attached to an inside wall of the cabinet. Hence heated air can flow into the drying chamber mostly in upward and sideward directions through the heat diffusion plate and the air ducts across the entire drying chamber for achieving uniform drying. A top opening is provided in the top wall of the cabinet for discharging used heated air and moisture-laden air. A suction fan may be provided above the top opening to facilitate air ventilation in the drying chamber and to help expelling vapor out of the drying chamber. Additional advantages of the present invention will be made apparent in the following description having reference to the accompanying drawings. The drawings are only to serve for reference and illustrative purpose, and do not intend to limit the scope of the present invention.

DETAILED DESCRIPTION OF THE PREFERRED EMBODIMENT

Figure 1:
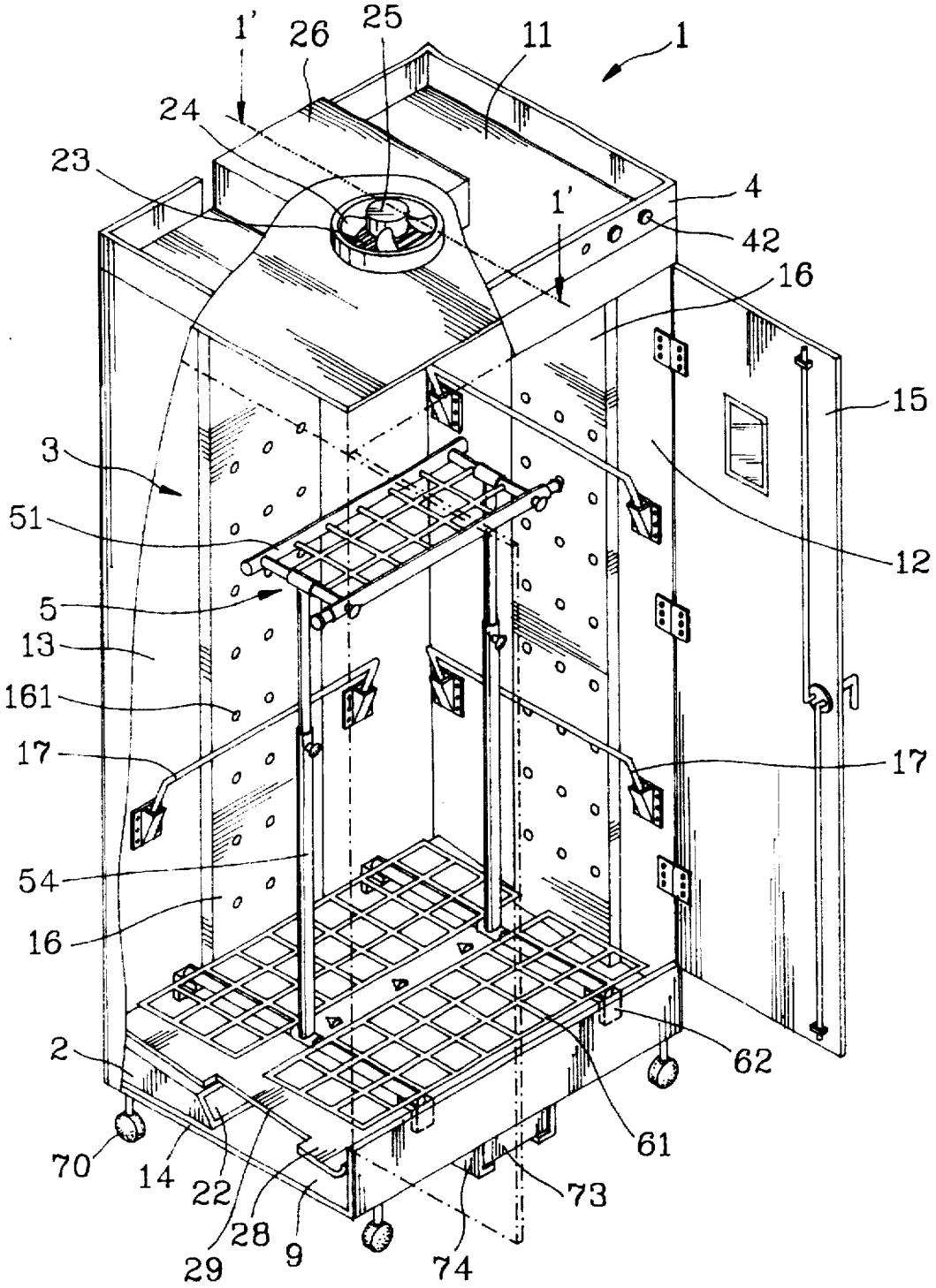
FIG. 1 is a perspective view, partly cutaway, of an embodiment of a household drying center according to this invention.
Figure 2:
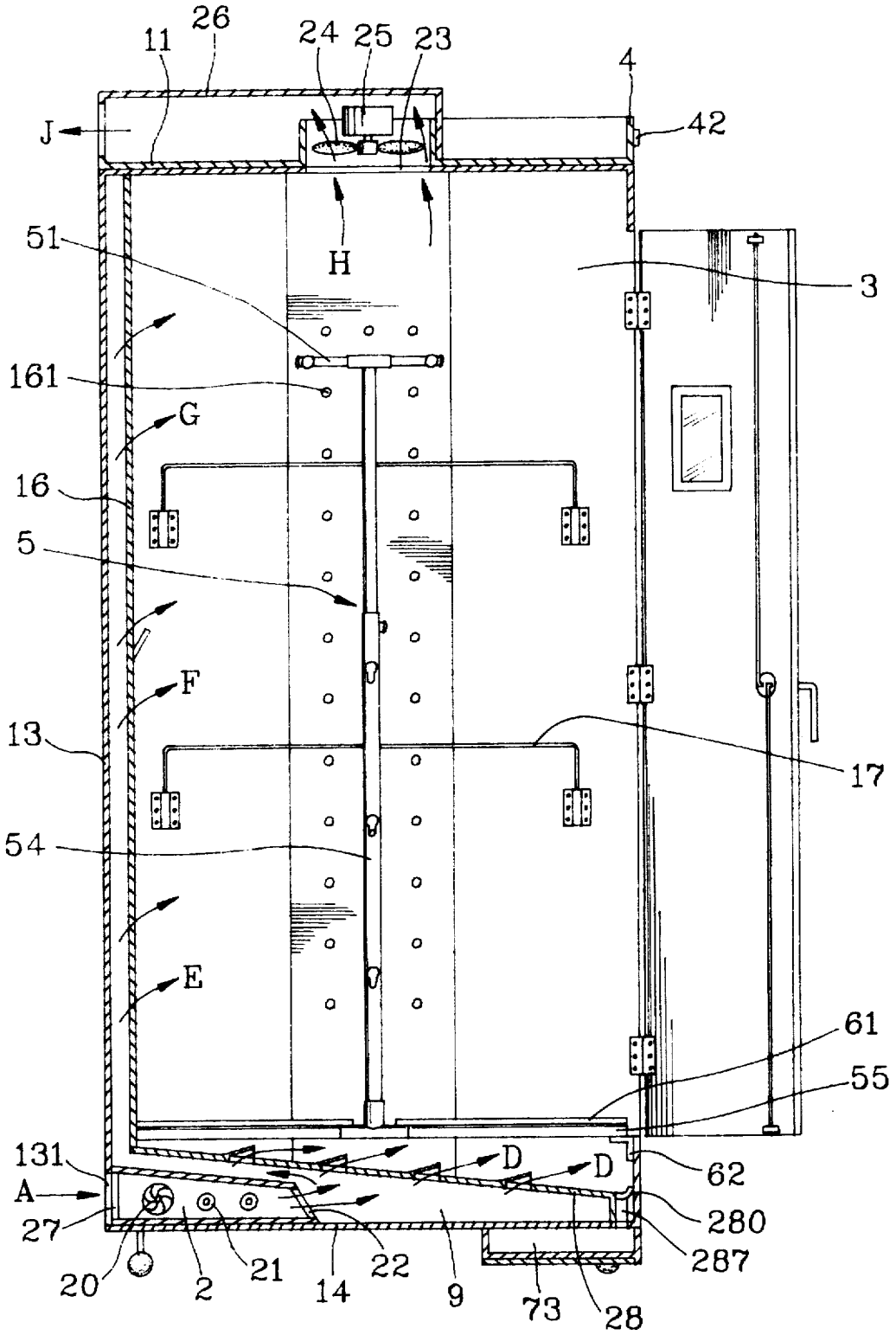
FIG. 2 is a side sectional view of this invention taken on line 1'—1' of FIG. 1.

Referring to FIGS. 1 and 2, a preferred embodiment of a drying center according to this invention includes a substantially rectangular cabinet 1 which has a top wall 11, a pair of lateral side walls 12, a rear side wall 13, a bottom wall 14 and a front side wall which has two doors 15 mounted thereon. The interior space of the cabinet 1 forms eventually two compartments, i.e. a dry chamber 3 located in the middle and upper portions, and a heated air chamber 9 located above the bottom wall 14. A heat diffusion plate 28 is slantly set between these two compartments. In the top wall 11, there is a top opening 23, preferably a louver type opening, for discharging used heated air from the drying chamber 3. A suction fan 24 driven by a fan motor 25 may be provided above the top opening 23 to facilitate air ventilation in the drying chamber 3. The suction fan 24 can further speed up the drying process for some delicate clothes or goods such as sweaters and stockings which usually should be aerated or dried in a relatively low temperature to avoid excessive shrinking. The top opening 23, fan 24 and motor 25 may further be covered and housed by a casing 26 which has a rear opening as an air outlet so that external dusts or dirts may be prevented from entering into the drying chamber 3.

Figure 3:
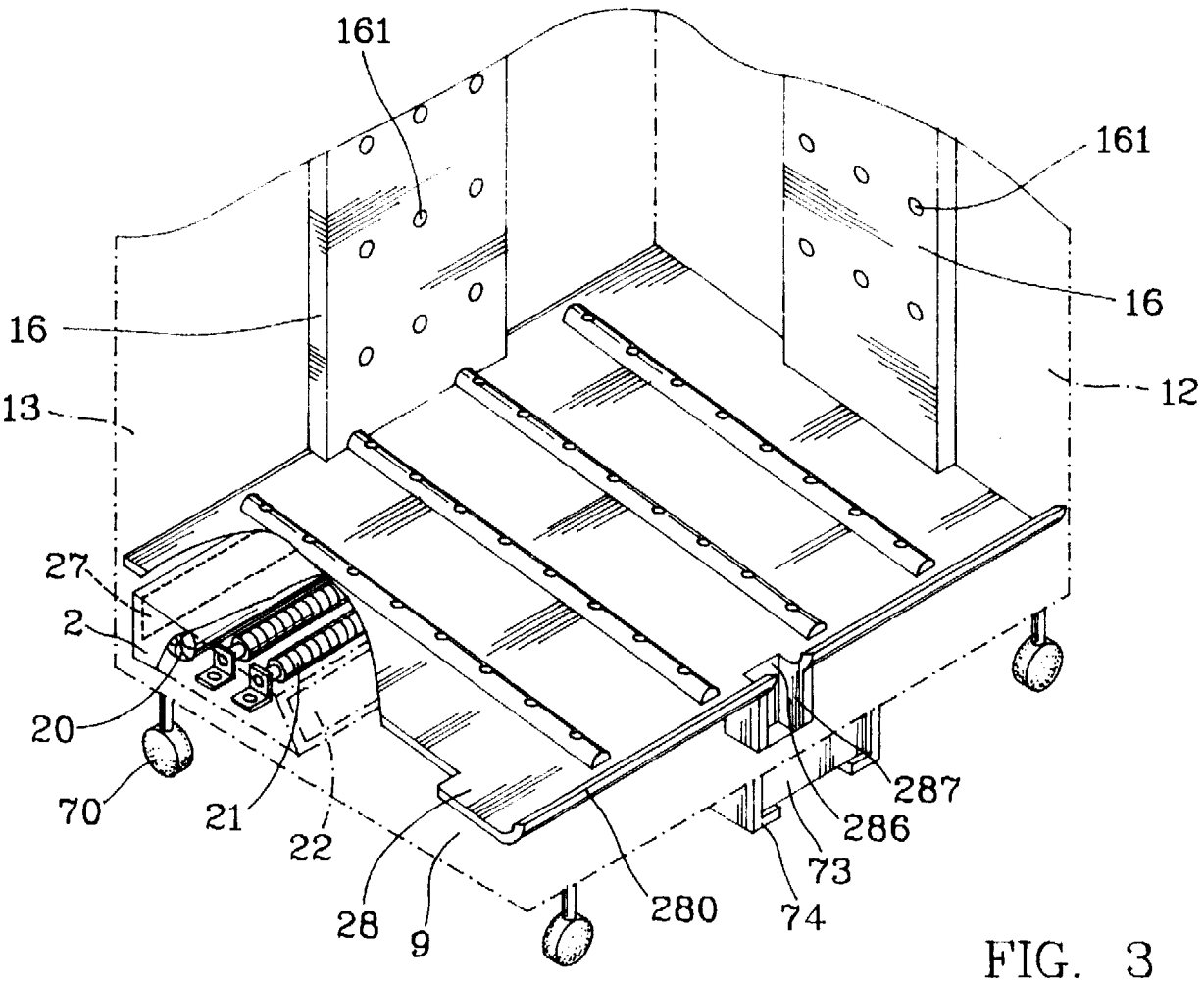
FIG. 3 is a pictorial view of a heating chamber and a heat diffusion plate of this invention.
Figure 4:
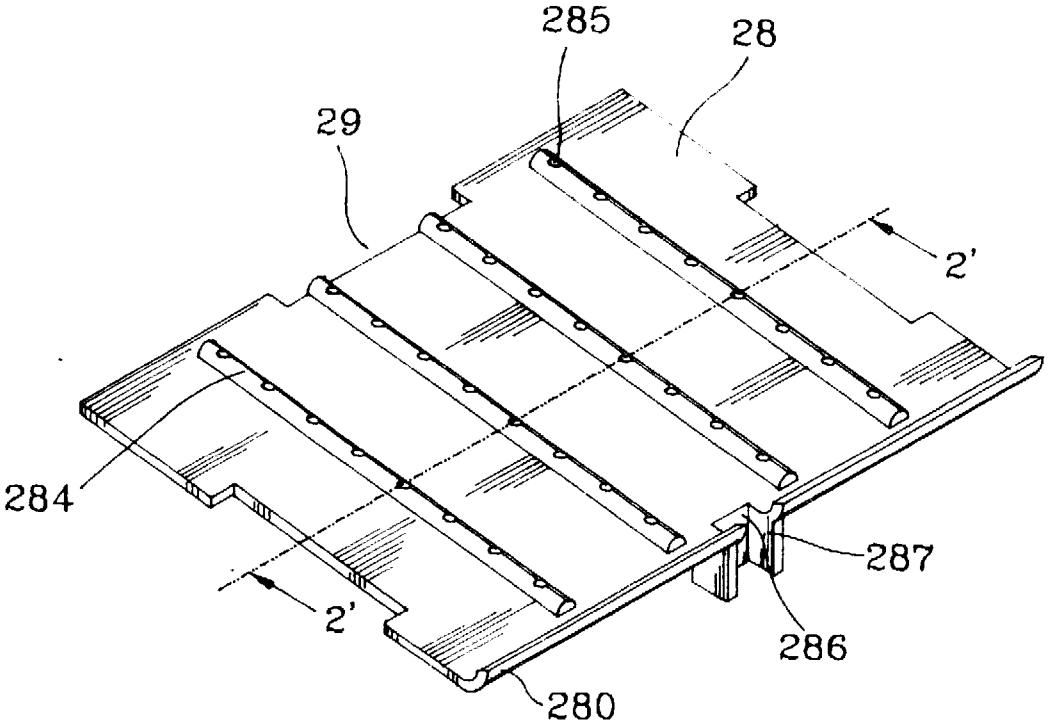
FIG. 4 is a perspective view of an embodiment of a heat diffusion plate.
Figure 5:
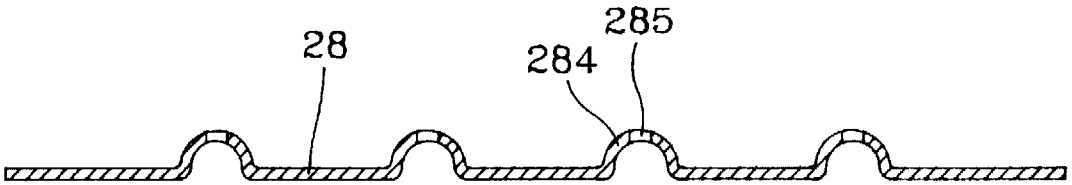
FIG. 5 is a cross section view of a heat diffusion plate taken on line 2'—2' of FIG. 4.

The heat diffusion plate 28 is preferably made of a metal sheet and substantially covers the entire cross-section of the cabinet. FIGS. 3, 4 and 5 illustrate a preferred embodiment of the heat diffusion plate 28. It has a plural number of corrugated ridges 284 longitudinally formed thereon. On the peak of each ridge 284, there is a plurality of spaced and punctured apertures 285 to allow heated air to pass therethrough. The lower edge 280 of the heat diffusion plate is bent upward to serve as a drain gutter. At the center of the lower edge 280, there is a notch 286 which engages with a drain chute 287 for discharging dripping water into a movable drip tray 73 located below the bottom wall 14 and supported by a pair of channels 74 for collection and disposal of the drips that might result from the wet laundry or other drying goods. The corrugated ridges 284 are to prevent dripping water from flowing into the heated air chamber 9 below.

Figure 6:
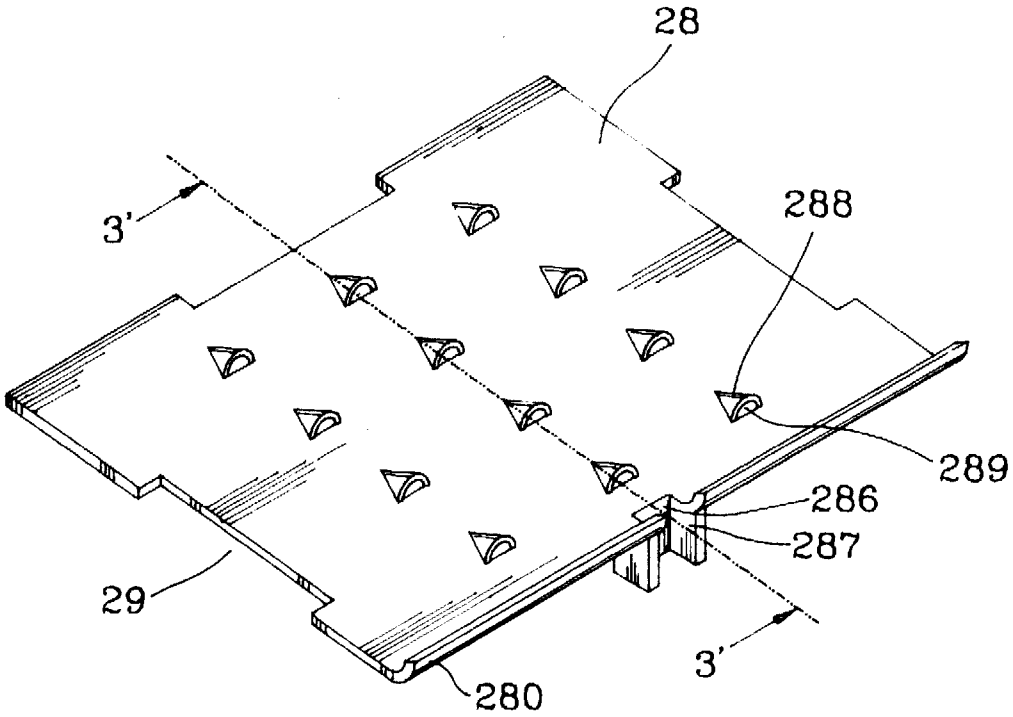
FIG. 6 is a perspective view of another embodiment of a heat diffusion plate.
Figure 7:
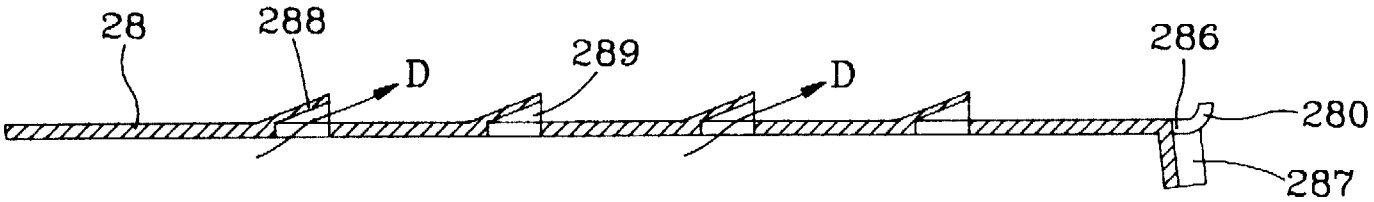
FIG. 7 is a sectional view of a heat diffusion plate taken on line 3'—3' of FIG. 6.

FIGS. 6 and 7 show another embodiment of the heat diffusion plate 28. It is substantially formed by a flat metal sheet. The lower edge 280 is also being bent upward to serve as a drain gutter. There is also a notch 286 at the center of the lower edge and a drain chute 287 for discharging dripping water. However instead of corrugated ridges, a plural number of semiconical roofs 288 are formed thereon and are spaced from each other. Under each semiconical roof 288, there is a punctured venting opening 289 which enables heated air flowing from the heated air chamber 9 into the drying chamber 3 (shown by arrows D in FIGS. 2 and 7). The roof 288 can prevent dripping water from entering into the heated air chamber 9 below.

The heated air chamber 9 is formed at a lower portion of the cabinet bordered by the heat diffusion plate 28 and the bottom wall 14. The heat diffusion plate 28 is disposed at a downward slope from a rear edge toward a front edge so that it can also serve as a drain board to collect and flush dripping water within the heated air chamber 9, there is a heating chamber 2 for generating forced and heated air to serve as drying medium.

The heating chamber 2 has a rear opening adjacent a side wall opening formed in the cabinet to serve as an air inlet 131 and a front opening 22 to serve as a heated air outlet. The front opening 22 directs heated air into the heated air chamber 9. Inside the heating chamber 2, there is a blower 20, preferably a cross-flow type, driven by another motor (not shown) for generating forced air to pass through a heating means 21, preferably a resistance type electric heater, which is also being housed in the heating chamber 2. Fresh air is drawn into the heating chamber 2 (shown by an arrow A in FIG. 2) by the blower 20 through the air inlet 131. A removable filter 27 may be provided and mounted in the air inlet 131 for preventing outside particles from entering into the heating chamber 2.

The heated air chamber 9 is to serve as an interim reservoir for receiving heated air from the heated chamber 2 and to distribute heated air to the drying chamber. In order to enable heated air to enter and fill the drying chamber evenly so that the goods held therein can be dried uniformly, this invention provides more than one type of heated air passages. One type of the heated air passage is the apertures 285 or venting openings 289 formed in the heat diffusion plate 28. Another type of the heated air passage is the hollow air ducts 16 which are vertically attached to the inside surface of the side walls of the cabinet 1. Each air duct 16 has a bottom opening engaged with a slot 29 formed on the side edge of the heat diffusion plate 28, a plural number of spaced apertures 161 formed in a lateral wall thereof facing the drying chamber 3, and a closed top end connecting to the top wall 11.

Above and around the top wall 11, there is a control panel 4 which has at least one control switches 42 which are wired to the fan motor 25, blower 20 and heating means 21 for selecting and setting operation mode desired.

Inside the drying chamber 3, there is a support means 5 preferably made by a pair of spaced and upright tubes 54 with a substantially rectangular and horizontal frame 51 secured on the top ends of the tubes 54. The frame 51 is spaced from the top wall and side walls of the cabinet. The upright tubes 54 may be telescopically structured so that the frame 51 may be moved upward or downward to suit different needs. The bottom end of each upright tube 54 is secured on a base bar 55 which is supported by a pair of brackets 62 attached to the side walls of the cabinet.

When in use, the frame 51 may be used to support hangers for hanging clothes, or to allow a large size or bulky goods such as quilt or blanket to drape thereon, or to support a wire basket thereon for holding goods which are not suitable for hanging or draping, such as sweaters, dishes, stuffed toys, shoes, sneakers, hats, etc. After the goods are loaded in the drying chamber 3, the door 15 is closed and the switches 42 are set to a desired temperature and operation duration. The blower 20 will be powered to draw fresh air A from outside atmosphere into the heating chamber 2. The forced air passes through the heating means 21 and be heated. Heated air flows out of the heating chamber 2 through the outlet 22, enters into the heated air chamber 9, and flows into the drying chamber 3 through the heat diffusion plate 28 (shown by arrows D) and the air ducts 16 (shown by arrows E, F and G in FIG. 2).

After heated air completes heat transfer and drying function on the drying goods, used heated air and moisture-laden air leave the drying chamber 3 through the top opening 23 (shown by arrows H). Fan 24 may help to discharge moisture-laden air into outside atmosphere (shown by an arrow J). The rotation speed of the fan 24 may be set at a desired level depends on the drying goods and drying temperature to avoid excessive heated air loss. Besides the support means 5, the inside surface of the side walls of the cabinet 1 may support one or more side rod means 17 for hanging small articles for drying. A base grid 61 may also be provided and placed above the base bars 55 for supporting heavy and odd shape goods for drying, such as shoes, boots, kitchen utensils, etc.

The size, quantity and location of the apertures and venting openings formed in the heat diffusion plates 28 and the air ducts 16 may be configurated as desired so that heated air may be evenly distributed across the entire drying chamber 3 to achieve uniform drying. Casters 70 may also be disposed under the bottom wall 14 to make this dryer movable easily to a desired location within or outside of the house.

The dryer according to this invention offers a lot of advantages over a conventional tumbler dryer. The versatile support means of this invention can hold and support a wide range of fabric and non-fabric goods for drying. It is particularly desirable for drying bulky goods in a limited floor space. Heating temperature and drying duration may be selected and set as desired to suit different types of drying goods. The drying goods are held stationary during the drying process. Hence there is no fraying or additional wrinkles which might otherwise incur by a rotary drum of a conventional dryer.

Furthermore, with the provision of the heat diffusion plate and air ducts, heated air may be evenly distributed in the drying chamber for uniform drying in an elongated cabinet.

With the heating chamber located at the bottom and a suction fan located at the top of the cabinet, heated air and moisture-laden air may be flowing mostly in upward and sideward directions so that used heated air and vapor may be expelled more easily out of the drying chamber.

It may thus be seen that the objects of the present invention set forth herein, as well as those made apparent from the foregoing description, are efficiently attained. While the preferred embodiments of the invention have been set forth for purpose of disclosure, modifications of the disclosed embodiments of this invention as well as other embodiments thereof may occur to those skilled in the art. Accordingly, the appended claims are intended to cover all embodiments which do not depart from the spirit and scope of this invention.

What is claimed is:

1. A household drying center for drying laundry, fabric articles and household goods, comprising;

a cabinet defined by a top wall, a bottom wall and a plurality of side walls, the top wall having a top opening formed therein, the bottom wall having a plurality of casters disposed thereunder;

a heat diffusion plate slantly located at a lower portion of the cabinet above the bottom wall to form a heated air chamber therebetween; the heat diffusion plate having a plural number of spaced apertures formed therein and a substantially rectangular side slot formed in each of side edges, a lower side edge being bent upward to form a drain gutter and having a drain outlet with a drain chute disposed therein;

a heating chamber located in the heated air chamber having a blower, a heating means, a heated air outlet, and a chamber side opening adjacent a cabinet side opening formed in one of the side walls of the cabinet;

a drying chamber formed and surrounded by the top wall, the side walls and the heat diffusion plate, the drying chamber including a door mounted on a front side wall and a plurality of hollow air ducts; each air duct being vertically disposed on an inside surface of the side wall and having an open bottom end engaged with the side slot of the heat diffusion plate for forming a heated air passage to the heated air chamber, a closed top end engaged with the top wall of the cabinet, and a plural number of spaced apertures formed in a lateral wall thereof facing the interior of the drying chamber;

a support means located in the drying chamber including a substantially horizontal frame means secured on a top end of an upright means which is supported at a bottom end thereof by a base bar secured to the side walls of the cabinet;

a control panel located above the top wall of the cabinet including at least one control switches for setting operation condition and time duration of the blower and the heating means; and a draining means located below the bottom wall of the cabinet including a movable drip tray for receiving dripping water from the drain chute.

2. A household drying center of claim 1, wherein the heat diffusion plate has a plurality of corrugated ridges formed longitudinally thereon along the slant direction, the apertures of the heat diffusion plate being formed on the peak of the ridges.

3. A household drying center of claim 1, wherein the heat diffusion plate has a plurality of semiconical roofs formed thereon, each aperture of the heat diffusion plate being located within the semiconical roof.

4. A household drying center of claim 1 further having a suction fan located above the top opening and a casing located above the top wall for covering the suction fan and the top opening, the casing having a side opening to form an air passage with the top opening of the cabinet.

5. A household drying center of claim 1, wherein the frame means of the support means is spaced from the top wall and the side walls of the cabinet.

6. A household drying center of claim 5, wherein the frame means is substantially rectangular.

7. A household drying center of claim 6, wherein the frame means includes a pair of spaced and transverse bars engaging respectively with a pair of spaced and longitudinal bars.

8. A household drying center of claim 7, wherein at least one of the transverse bars is telescopically structured.

9. A household drying center of claim 1, wherein the upright means includes a pair of spaced struts.

10. A household drying center of claim 9, wherein the struts are telescopically structured.

11. A household drying center of claim 1, wherein a first control switch is for setting the heating means to generate various levels of heat output.

12. A household drying center of claim 1, wherein a second control switch is for setting the blower and the heating means to function at various time duration.

13. A household drying center of claim 1 further having at least one substantially inverted 'U' shape side rod means pivotably disposed on the inside surface of the side wall of the cabinet.

* * * * *